US012607103B2

(12) United States Patent
Williams et al.

(10) Patent No.: US 12,607,103 B2
(45) Date of Patent: Apr. 21, 2026

(54) SELF-ADJUSTING DOWNHOLE SUCKER ROD PUMP SPACING TOOL

(71) Applicants: Benny J. Williams, Godley, TX (US); John D. Williams, Burleson, TX (US)

(72) Inventors: Benny J. Williams, Godley, TX (US); John D. Williams, Burleson, TX (US)

( * ) Notice: Subject to any disclaimer, the term of this patent is extended or adjusted under 35 U.S.C. 154(b) by 147 days.

(21) Appl. No.: 18/671,292

(22) Filed: May 22, 2024

(65) Prior Publication Data

US 2025/0361800 A1 Nov. 27, 2025

(51) Int. Cl.

| | |
|---|---|
| ***E21B 43/12*** | (2006.01) |
| ***F04B 47/02*** | (2006.01) |
| ***F04B 53/12*** | (2006.01) |

(52) U.S. Cl.

CPC ..... *E21B 43/127* (2013.01); *F04B 47/026* (2013.01); *F04B 53/126* (2013.01); *E21B 2200/04* (2020.05)

(58) Field of Classification Search

CPC ..... Y10S 417/904; Y10T 74/2151; E21B 43/121; E21B 43/126; E21B 43/127

See application file for complete search history.

(56) References Cited

U.S. PATENT DOCUMENTS 1,577,706 A * 3/1926 Fowlie ..... F04B 7/0073 417/511
2,103,236 A * 12/1937 Coshow ..... E21B 19/02 175/321
2,251,290 A * 8/1941 Reed ..... F04B 47/04 91/55
2,918,014 A * 12/1959 Gould ..... F04B 47/00 417/384
2,927,478 A * 3/1960 Aucamp ..... F03D 15/15 74/586
3,367,279 A * 2/1968 Crowe ..... E21B 43/12 92/84
3,376,826 A * 4/1968 Crowe ..... F04B 53/144 92/84
4,653,383 A * 3/1987 Henderson ..... F04B 49/12 92/13.1
10,053,936 B2 * 8/2018 Herod ..... E21B 23/01

* cited by examiner

*Primary Examiner* — Kipp C Wallace
(74) *Attorney, Agent, or Firm* — Brian K. Yost; Kiala E. Ellingson; Decker Jones, PC

(57) ABSTRACT

A downhole tool comprises a cylinder, piston, and piston rod, the piston rod comprising first and second ends, the first end being external to the cylinder and having the capacity to be operatively connected to a sucker rod string or a sucker rod pump, the second end being positioned within a sealed cylinder chamber and attached directly or indirectly to the piston. The cylinder confining fluid within the cylinder chamber. The piston is coaxially positioned within the cylinder chamber such that the piston and cylinder share a central longitudinal axis. The piston and cylinder each comprise respective sidewalls, the respective sidewalls defining a lateral space between the piston and the cylinder. The lateral space and a piston conduit have the capacity to permit the fluid to move from a first chamber to a second chamber and to permit the fluid to move from the second chamber to the first chamber.

18 Claims, 4 Drawing Sheets

SELF-ADJUSTING DOWNHOLE SUCKER ROD PUMP SPACING TOOL

BACKGROUND OF THE INVENTION

1. Field of the Invention

The present invention relates generally to a downhole tool for use in oil and gas artificial lift production operations and specifically to a self-adjusting downhole sucker rod pump spacing tool.

2. Description of the Prior Art

This invention relates to a device that helps maintain adequate spacing between the bottom of a sucker rod string and the top of a sucker rod pump. In conventional oil and gas artificial lift production operations, a reciprocating pump ("sucker rod pump") is positioned deep within the wellbore. The sucker rod pump is reciprocated by a sucker rod string comprised of numerous individual threaded sucker rods joined to one another. The sucker rod string extends between the sucker rod pump and a pump jack positioned on the ground surface. Each sucker rod is generally 25 to 30 feet in length and only ¾ to 1 inch in diameter. The sucker rod string can be thousands of feet in length. Conventional pump jacks comprise a walking beam, horse head, and crank arrangement that, together, translate rotational motion of the shaft of a surface motor to vertical oscillatory movement of the sucker rod string. As the action of the pump jack necessarily causes the sucker rod string to move in a series of alternating upward and downward movements, the sucker rod string undergoes significant strain. Each sucker rod must support at least the weight of all the sucker rods below it together with the weight of the sucker rod pump plunger and any fluid lifted. Thus, the fluid load and sudden upward reversal at the end of the downstroke typically causes the individual sucker rods in the string to stretch. The reverse condition occurs upon the downward reversal at the end of the upstroke which cause the sucker rods in the string to shorten.

This quantity of lengthening and shortening of the sucker rod string can change and thus alter the operational spacing of the sucker rod pump due to changes in variable loads imparted to the sucker rod string, i.e., changing fluid level in the casing-tubing annulus or changing fluid/gas ratio. "Operational spacing" in an insert style sucker rod pump refers to the position of the sucker rod pump top valve rod bushing relative to the valve rod guide at the top of the pump. For example, it is desirable for the sucker rod pump top valve rod bushing to be positioned such that there is approximately one to two inches of clearance between the sucker rod pump top valve rod bushing and the valve rod guide at the top of the pump at the bottom of the downstroke. Generally, operators attempt to make sure not to space the sucker rod pump top valve rod bushing too far from the valve rod guide, which would lessen the sucker rod pump compression ratio, or too close which could cause destructive contact between the top valve rod bushing and valve rod guide (tagging.) When spacing a sucker rod pump, the rod string is raised to lift the sucker rod pump plunger from the bottom of the sucker rod pump. The rod string is then lowered a few inches at a time until the sucker rod pump top valve rod bushing "tags or touches" the top of the sucker rod pump. The rod string is then slowly raised to a desired position determined by using certain formulas that consider predicted stretching and overtravel that occurs during ongoing pumping operations.

Knowing exactly where the traveling valve is in relation to the sucker rod pump bottom is critical for efficient well production. Unfortunately, even with use of state of the art practices and materials in sucker rods, the amount of sucker rod string stretch and over travel is not static. Stretch and over travel can vary depending upon pumping speed, the level of fluid in the well (casing-tubing annulus), the ratio of or amount of fluids and gas being raised, and other factors. The amount of stretch and over travel can even vary during the course of a single day and is not always predictable. Variations in stretching and over travel can cause the sucker rod pump to reciprocate within undesirable spacing. For example, the sucker rod pump top valve rod bushing may tag at the bottom of the downstroke or be spaced too high for efficient compression. Tagging can damage the sucker rod string, the sucker rod pump, tubing, and surface equipment. Downhole impacts can cause compression of the rod string which damages the sucker rods, tubing, and connections, in that tagging causes the rods to bow and to slap the inside of the tubing. Though these impacts occur downhole, they are also destructive to the pump jack at the surface. Even without tagging, the sucker rod pump plunger can migrate from desired spacing to undesired spacing. This can cause production problems due to inefficient compression. When sucker rod pump plunger spacing deteriorates, the conventional way of adjusting the spacing is to shut the well down and adjust the rod string up off the tag or down to achieve higher compression by, for example, relocating the polished rod clamp in order to lengthen or shorten the effective rod string length.

Additionally, sucker rod pumps can undergo fluid pound and gas lock. Fluid pound occurs when the traveling valve strikes the fluid level in the sucker rod pump barrel during the downstroke. As fluid pound is a shock to the downhole equipment, similar damage can occur as that which results from tagging.

Gas lock is a condition which occurs when gas enters the area below the sucker rod pump plunger such that the sucker rod pump plunger cannot compress the gas on the downstroke with sufficient pressure to force the traveling valve open. On the upstroke, the gas expands causing the standing valve to remain closed such that the standing valve does not permit fluid to enter the sucker rod pump. This action repeats itself on each subsequent downstroke and upstroke for an undetermined time. One "solution" to this problem is to space the sucker rod pump such that the sucker rod pump actually tags on every stroke attempting to dislodge the traveling valve ball from its seat. As stated, tagging is generally undesirable and very destructive.

Attempts have been made in an effort to adjust sucker rod pump spacing and to prevent tagging, fluid pound, and gas lock. For example, U.S. Pat. No. 11,168,549 to Ewing discloses a complex device with an actuator that drives a threaded shaft at the surface such that the sucker rod string length may be shortened and lengthened.

U.S. Pat. No. 4,963,078, Agee, provides a device intended to dissipate shock forces occurring from fluid pound, gas pound and/or deliberately tagging the sucker rod pump to avoid gas lock. The Agee device comprises a piston and cylinder arrangement that use ports to alternatively intake and exhaust fluid into/out of the cylinder.

Similarly, U.S. Pat. Nos. 6,068,052 and 9,045,949, Dobbs, provide a downhole "no tap" tool which connects the last sucker rod of a sucker rod string to a downhole pump.

The Dobbs devices each have a cylinder and piston arrangement that upon reciprocation of the piston within the cylinder causes fluid to enter and exit the cylinder.

Although prior art devices are adequate for the purposes for which they are intended, none provide a simple and economical solution to sucker rod pump spacing issues. What is needed is a downhole tool that self-adjusts sucker rod pump operational spacing by adjusting the length of the sucker rod string.

SUMMARY OF THE INVENTION

The downhole tool of the present disclosure is uncomplicated and maintains desired sucker rod pump operational spacing by self-adjusting. The self-adjusting downhole sucker rod pump spacing tool comprises a closed system such that fluid does not move in and out of the cylinder. Rather fluid simply transfers back and forth as needed within the cylinder, above and below the piston.

The self-adjusting downhole sucker rod pump spacing tool of a first preferred embodiment generally comprises a cylinder, piston, and connecting cylinder rod. The cylinder rod and piston are attached to one another via an intermediate connector and are coaxially positioned within the cylinder such that the piston and piston rod share a central longitudinal axis with the cylinder. The piston has an outside diameter that is slightly less than the inside diameter of the cylinder. Thus, a specified lateral space is present between the piston and the cylinder. This lateral space permits a small amount of fluid to pass between the piston and the cylinder.

In this and other embodiments, the fluid is preselected to have a suitable viscosity to permit the piston to move within the cylinder more freely or less freely, with more or less transfer of fluid from above and below the piston, depending on the application. In preferred embodiments, the fluid comprises hydraulic oil having a viscosity of approximately 5 W to 20 W. The fluid can be a single liquid or gas or a mixture of two or more liquids and/or gasses. By way of example, but not limitation, the fluid can be water based, petroleum based, and/or synthetic and can be compressible or incompressible.

An upper portion of the piston rod has the capacity to connect the piston rod to the lowermost portion of the sucker rod string. A lower portion of the piston rod has the capacity to connect the piston rod to the intermediate connector of the piston.

The cylinder is enclosed at the top with an upper seal cap and enclosed at the bottom with lower cap. The upper seal cap comprises seal rings which surround the piston rod. This arrangement permits the piston rod to be repositioned axially within a central opening of the upper seal cap while also preventing fluid and/or gas from entering or escaping the cylinder. The upper and lower caps are each threadedly connected to the cylinder, with the lower cap connected to the sucker rod pump.

The lower portion of the piston rod is connected to an upper connector portion of the intermediate connector. The upper end of the piston is connected to a lower portion of the intermediate connector. The lower end of the piston comprises a piston cap threadedly connected to the piston.

The downhole sucker rod pump spacing tool is first adjusted by touching or tagging the tool against the sucker rod pump while the tool and sucker rod pump are both downhole. This action of moving the tool such that a portion of the tool contacts a portion of the sucker rod pump causes the piston to move towards a lower portion of the cylinder which shortens the overall length of the downhole sucker rod pump spacing tool and shortens the effective length of the sucker rod string. Thus, upon the spacing tool contacting the sucker rod pump on the downstroke of the pump jack causes the piston to relocate downward within the cylinder causing the overall length of the spacing tool to shorten and causing a small portion of the fluid to move from a lower cylinder chamber upwardly to the upper cylinder chamber along a path defined by the lateral space between the piston and the cylinder.

However, because the lateral space is very narrow and pressures caused by an upstroke of the pump jack are much lower than pressures caused by a tagging action, on the upstroke of the pump jack, the opposite action does not occur in the same magnitude. On the upstroke, the sucker rod string does not cause the piston to appreciably reciprocate upward within the cylinder. Fluid within an upper cylinder chamber together with the narrowness of the lateral space and viscosity of the fluid, inhibits movement of the piston upward such that on the upstroke, the fluid within the upper cylinder chamber does not move appreciably downward along the path defined by the lateral space between the piston and the cylinder. The lateral space between the device piston and the cylinder is very small, approximately 1/5000's of an inch in preferred embodiments. Therefore, virtually no fluid moves within the lateral space during regular pumping action of the pump jack. Consequently, on every upstroke, the self-adjusting downhole sucker rod pump spacing tool approximately retains its position relative to the sucker rod pump.

Likewise, on every subsequent downstroke after the initial tagging, the downstroke pressures are not sufficient to cause the piston to appreciably relocate downward within the cylinder. In preferred embodiments, the only action that causes immediate appreciable movement of the piston within the cylinder is the tagging action. After the tagging occurs, with subsequent self-adjusting (shorter), the piston and cylinder move as a single unit during normal pumping operations such that the overall length of the self-adjusting downhole sucker rod pump spacing tool remains approximately constant.

Although, the self-adjusting downhole sucker rod pump spacing tool moves as a single unit during normal pumping action such that the piston does not move up and down within the cylinder, over time (for example, after 10,000 strokes/reciprocations), the piston will gradually change position within the cylinder causing the overall length of the spacing tool to lengthen. As the length of the spacing tool increases, the distance between the spacing tool and the sucker rod pump decreases. The decreased distance between the spacing tool and the sucker rod pump will ultimately result in the spacing tool once again tagging against the sucker rod pump. Upon a new tag, the self-adjusting downhole sucker rod pump spacing tool self-adjusts as described above, such that its overall length again becomes shorter. This action maintains an optimal close spacing of the sucker rod pump.

In the first embodiment, the fluid passes outside the perimeter of the piston and not within the piston itself. In other embodiments discussed below, the fluid also passes through one or more passages in the piston.

The self-adjusting downhole sucker rod pump spacing tool of a second preferred embodiment comprises a valve assembly threadedly connected to the piston. The valve assembly of this embodiment is a one-way check valve assembly comprising a valve body, a ball, and seat, the valve body and seat comprising a fluid passage. The fluid passage is fluidly communicative with a chamber of a valve body seat plug. The valve body seat plug of this embodiment is threadedly connected to the lower end of the valve body. The valve body seat plug chamber is fluidly communicative with a lower cylinder chamber. An upper end of the valve body optionally comprises a funnel configuration. Extending upward from the valve body is piston conduit. The piston conduit is fluidly connected to the valve body and is coaxial with the piston. At an upper end of the piston conduit and fluidly connected to the piston conduit are piston conduit dome and piston conduit dome passage. The piston conduit dome passage extends through the intermediate connector to a position exterior to the intermediate connector within an upper cylinder chamber.

In the second embodiment, in addition to the downstroke initial tagging action causing the fluid to move upward through the lateral space between the piston and the cylinder, the downstroke initial tagging causes the ball to rise from the seat such that a greater portion of the fluid passes from the lower cylinder chamber, through the valve body seat plug chamber, through the valve seat fluid passage, the piston conduit, piston conduit dome, piston conduit dome passage, and into the upper cylinder chamber.

In a third embodiment, the self-adjusting downhole sucker rod pump spacing tool comprises one or more orifices. The orifice is a through opening that permits fluid communication between the valve body and space between the valve assembly and the cylinder during the upstroke of the pump. In this embodiment, the one or more orifices allow fluid to pass from the upper chamber to the lower chamber at the same time as fluid passes between the piston and cylinder which increases the total quantity of fluid passed. In preferred embodiments, the orifice is part of a threaded assembly inserted into a side of the valve body above the ball and seat. The orifice can be positioned in other positions that permit fluid to move, via the orifice, to and between the first and second chambers. The orifice of the preferred embodiment is an opening having a diameter of 1/64 of an inch, for example.

In preferred embodiments, the self-adjusting downhole sucker rod pump spacing tool has the capacity to also work with a downhole reciprocating sucker rod pump in which the sucker rod pump barrel is affixed to the tubing and the sucker rod pump plunger reciprocates within the stationary sucker rod pump barrel. In other embodiments, the self-adjusting downhole sucker rod pump spacing tool is used with other types of sucker rod pumps such as a travel barrel pump or insert style pumps.

DESCRIPTION OF THE PREFERRED EMBODIMENT

Referring to FIGS. 1-4, there is shown the self-adjusting downhole sucker rod pump spacing tool 12 in accordance with preferred embodiments. As used herein, the terms "a" or "an" shall mean one or more than one. The term "plurality" shall mean two or more than two. The term "another" is defined as a second or more. The terms "including" and/or "having" are open ended (e.g., comprising). The term "or" as used herein is to be interpreted as inclusive or meaning any one or any combination. Therefore, "A, B or C" means "any of the following: A; B; C; A and B; A and C; B and C; A, B and C." An exception to this definition will occur only when a combination of elements, functions, steps, or acts are in some way inherently mutually exclusive. Except as otherwise provided herein, use of the terms "down", "up", "downward", "upward", "downwardly", and "upwardly", and similar directional terms are used with reference to the tool 12, as connected to a sucker rod string suspended from a pump jack, such that "up", "upward" and "upwardly" refer to a position or movement near or towards the pump jack and such that "down", "downward", and "downwardly" refer to a position or movement farther or away from the pump jack.

Reference throughout this document to "one embodiment," "certain embodiments," "an embodiment," or similar term means that a particular feature, structure, or characteristic described in connection with the embodiment is included in at least one embodiment of the present disclosure. Thus, the appearances of such phrases in various places throughout this specification are not necessarily all referring to the same embodiment. Furthermore, the particular features, structures, or characteristics may be combined in any suitable manner on one or more embodiments without limitation. The detailed description illustrates by way of example, not by way of limitation, the principles of the invention. This description will clearly enable one skilled in the art to make and use the invention, and describes several embodiments, adaptations, variations, alternatives, and uses of the invention, including what is presently believed to be the best mode of carrying out the invention.

Figure 4:
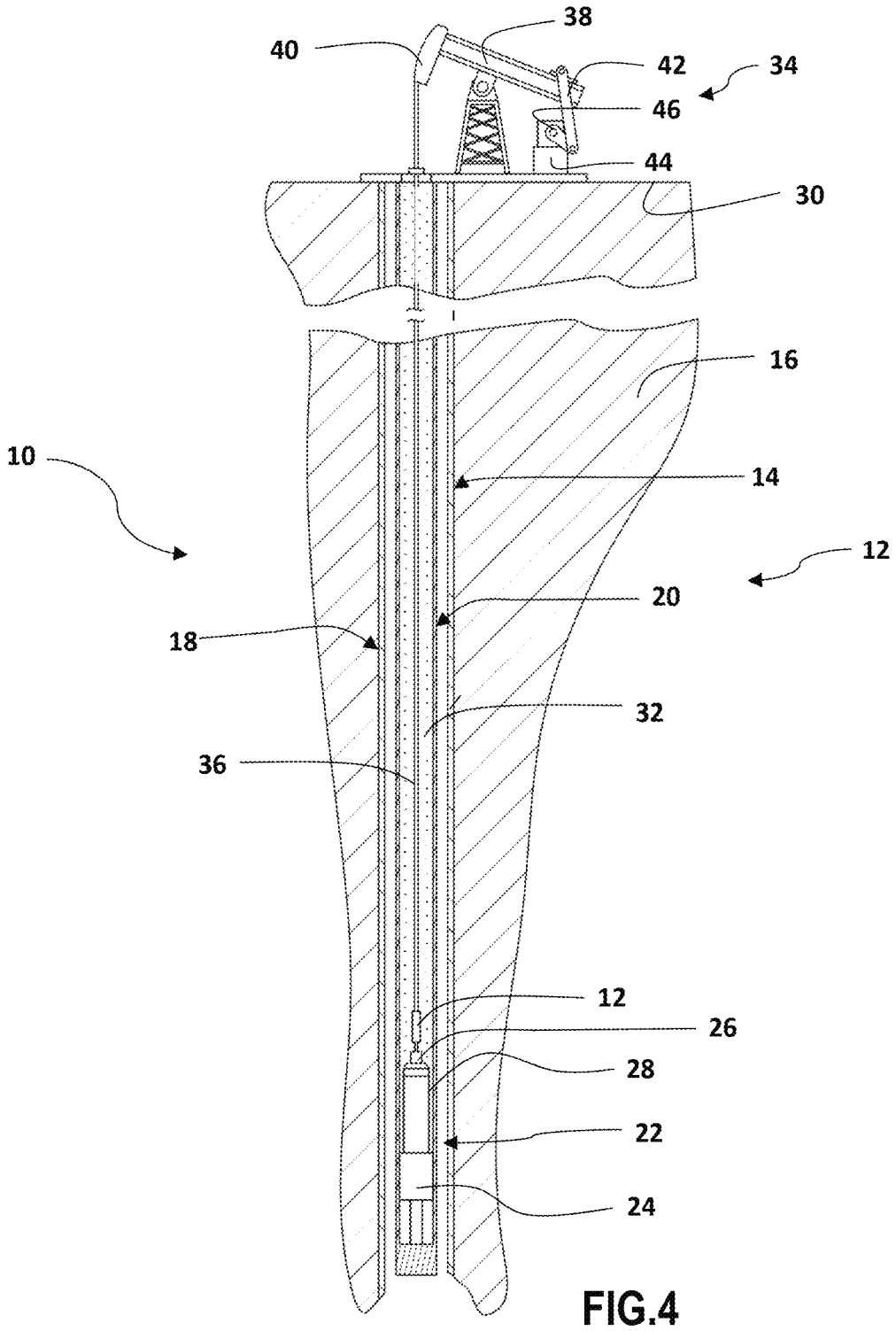
FIG. 4 is a side elevation view of a pump jack positioned on the surface and the self-adjusting downhole sucker rod pump spacing tool of certain preferred embodiments attached to a sucker rod end and positioned within a well casing, attached to a sucker rod pump.

Referring to FIG. 4, there is shown a conventional hydrocarbon well arrangement 10 which depicts a wellbore 14, drilled in the earth 16, the wellbore 14 being lined with a casing 18. Suspended coaxially within the casing 18 is tubing 20. The casing 18 is perforated in a production zone to permit hydrocarbons to enter the casing 18. A sucker rod pump 22 is seated and sealed in the tubing by a seating nipple 24. A sucker rod pump plunger 26 reciprocates within a sucker rod pump barrel 28 which action causes fluid 32 to upwardly travel within the tubing 20 to the surface 30. A pump jack 34 is operatively connected to a sucker rod string 36. The pump jack 34 generally comprises a walking beam 38, a horse head 40 and crank arrangement 42 that, together, translate rotational motion of the crankshaft 46 of a surface motor 44 to vertical reciprocating movement of the sucker rod string 36. The self-adjusting downhole sucker rod pump spacing tool 12 is positioned between the sucker rod string 36 and the sucker rod pump 22.

A First Embodiment

Figure 1:
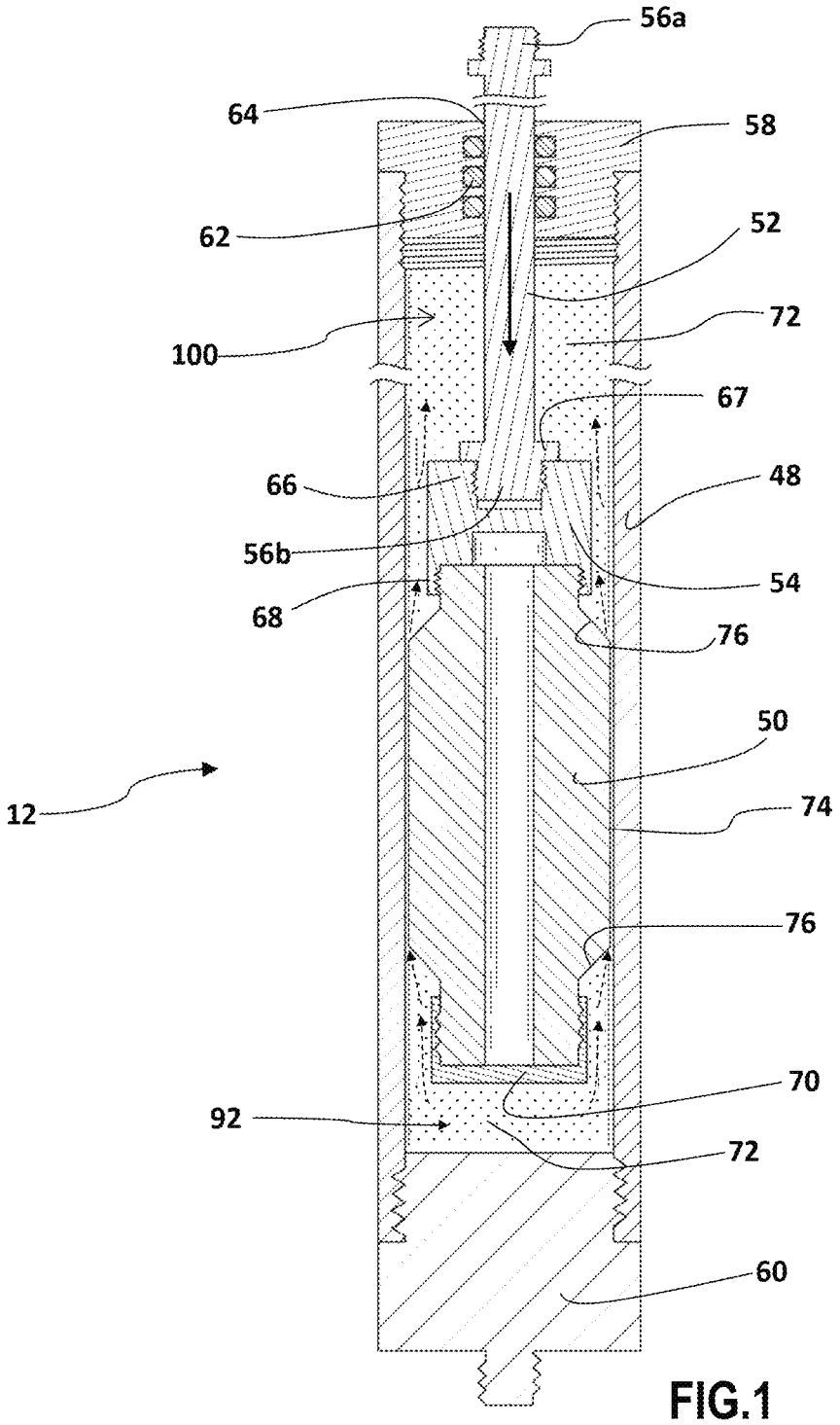
FIG. 1 is a sectional view of the self-adjusting downhole sucker rod pump spacing tool in accordance with a first preferred embodiment depicting the piston moving downward and the fluid upward during a tagging procedure.

Referring to FIG. 1, the self-adjusting downhole sucker rod pump spacing tool 12 of a first preferred embodiment generally comprises a cylinder 48, piston 50, and piston rod 52. In this and other preferred embodiments, the self-adjusting downhole sucker rod pump spacing tool 12 provides a closed system in which fluid 72 within the cylinder 48 is retained within the cylinder 48 and external fluids are excluded from the cylinder 48. The piston rod 52 and piston 50 are attached to one another via intermediate connector 54 and are coaxially positioned within the cylinder 48 such that the piston 50 and piston rod 52 share a central longitudinal axis with the cylinder 48. The piston 50 has an outside diameter that is slightly less than an inside diameter of the cylinder 48. Thus, a lateral space 74 is present between the piston 50 and the cylinder 48. This lateral space 74 permits fluid 72 to pass between the piston 50 and the cylinder 48.

In this and other embodiments, the fluid 72 is preselected to have a suitable viscosity to permit the piston 50 to move within the cylinder 48 more freely or less freely, depending on the application. In preferred embodiments, the fluid 72 comprises hydraulic oil having a viscosity of approximately 5 W to 20 W. The fluid 72 can be a single liquid or gas or a combination of two or more liquids and/or gasses and/or additives. By way of example, the fluid 72 can be water based, petroleum based, and/or synthetic and can be compressible or incompressible. The fluid 72 can be multigrade such that its viscosity changes depending upon the temperature or conditions. The fluid 72 can comprise additives such as viscosity index improvers.

An upper portion of the piston rod 52 comprises a conventional threaded connector 56*a* configured to connect the piston rod 52 to the lowermost portion of the sucker rod string 36. A lower portion of the piston rod 52 comprises a conventional threaded connector 56*b* and optional flange 67 arrangement configured to connect the piston rod 52 to the intermediate connector 54.

The cylinder 48 is enclosed at the top with an upper seal cap 58 and enclosed at the bottom with lower cap 60. The upper seal cap 58 comprises seal rings 62 which surround the piston rod 52. This arrangement permits the piston rod 52 to be repositioned axially within a central opening 64 of the upper seal cap 58 while also preventing fluid within the cylinder 48 from escaping the cylinder 48. The upper and lower caps 58, 60 are each threadedly connected to the cylinder 48.

The lower portion of the piston rod 52 is connected to an upper connector portion 66 of the intermediate connector 54. The upper end of the piston 50 is connected to a lower portion 68 of the intermediate connector 54. The lower end of the piston 50 comprises a piston cap 70 threadedly connected to the piston 50.

The operation of the self-adjusting downhole sucker rod pump spacing tool 12 of the first preferred embodiment will now be discussed. Referring to FIG. 1, the downhole sucker rod pump spacing tool 12 is first adjusted by touching the tool 12 against the sucker rod pump 22 while the tool 12 and sucker rod pump 22 are both downhole. This action of moving the tool 12 such that a portion of the tool 12 contacts a portion of the sucker rod pump 22 causes the piston 50 to move towards a lower portion of the cylinder 48 (such movement depicted in this and some other figures by a downward arrow) which shortens an overall length of the downhole sucker rod pump spacing tool 12. Thus, upon the spacing tool 12 contacting the sucker rod pump 22 on the downstroke of the pump jack 34, the sucker rod string 36 attached to the piston rod 52 causes the piston rod 52 and piston 50 to relocate downward within the cylinder 48 causing the overall length of the spacing tool 12 to shorten and causing the fluid 72 to move from a lower cylinder chamber 92 upwardly along a path defined by the lateral space 74 between the piston 50 and the cylinder 48 (fluid movement in this and other figures is represented by dashed arrows).

However, because the lateral space 74 is very narrow and pressures caused by an upstroke of the pump jack 34 are much lower than pressures caused by a tagging action, on the upstroke of the pump jack 34, the opposite action does not appreciably occur. On the upstroke, the sucker rod string 36 attached to the piston rod 52 does not cause the piston rod 52 and piston 50 to which the piston rod is attached to appreciably move upward within the cylinder 48. Fluid 72 within an upper cylinder chamber 100 together with the narrowness of the lateral space 74 and viscosity of the fluid 72, inhibits movement of the piston 50 upward such that on the upstroke, the fluid 72 within the upper cylinder chamber 100 does not move appreciably downward along the path defined by the lateral space 74 between the piston 50 and the cylinder 48. The lateral space 74 between the device piston and the cylinder is very small, approximately 1/5000's of an inch in preferred embodiments. Therefore, virtually no fluid 72 moves within the lateral space 74 during regular pumping action of the pump jack 34. Consequently, on every upstroke, the self-adjusting downhole sucker rod pump spacing tool 12 approximately retains its position relative to the sucker rod pump 22.

Likewise, on every subsequent downstroke after the initial tagging, the downstroke pressures are not sufficient to cause the piston 50 to appreciably reciprocate downward within the cylinder 48. In preferred embodiments, the only action that causes immediate appreciable movement of the piston 50 within the cylinder 48 is the tagging action. After the tagging occurs, the piston 50 and cylinder 48 move as a single unit during normal pumping operations such the overall length of the self-adjusting downhole sucker rod pump spacing tool 12 remains substantially constant during normal pumping operations.

Although, the self-adjusting downhole sucker rod pump spacing tool 12 moves as a single unit during normal pumping action such that the piston 50 does not move up and down within the cylinder 48, over time (for example, after 10,000 strokes/reciprocations), the piston 50 may gradually change position within the cylinder 48 causing the overall length of the spacing tool 12 to lengthen. As the length of the spacing tool 12, increases, the distance between the spacing tool 12 and the sucker rod pump 22 decreases. The decreased distance between the spacing tool 12 and the sucker rod pump 22 may ultimately result in the spacing tool 12 once again touching against the sucker rod pump 22. Upon a new touch, the self-adjusting downhole sucker rod pump spacing tool 12 self-adjusts as described above, such that its overall length again becomes shorter. This cycle continues during pumping such that the spacing of the sucker rod pump is just above a tag and thus the most efficient spacing possible.

In the first embodiment, the fluid 72 passes outside the perimeter of the piston 50 and not within the piston 50 itself. In other embodiments discussed below, the fluid 72 also passes through one or more passages 94 in the piston 50.

Although the dimensions can vary, the following approximate dimensions of preferred embodiments are provided. The piston rod 52 has a length of approximately five feet and a diameter of ⅞ inch. The cylinder 48 has a length of approximately seven feet and an outside diameter of approximately 1⅞ inches. The piston 50 has a length of approximately three feet and a diameter of approximately 1½ inches. The lateral space 74 has a diametral width of approximately 0.010 inches such that there is approximately.

0.005 inch clearance between the outside side surface of the piston 50 and an inside side surface of the cylinder 48. There is approximately a 1½ inch clearance between the piston cap 70 and the lower cap 60 when the piston 50 is positioned at its lowest position.

A Second Embodiment

Figure 2:
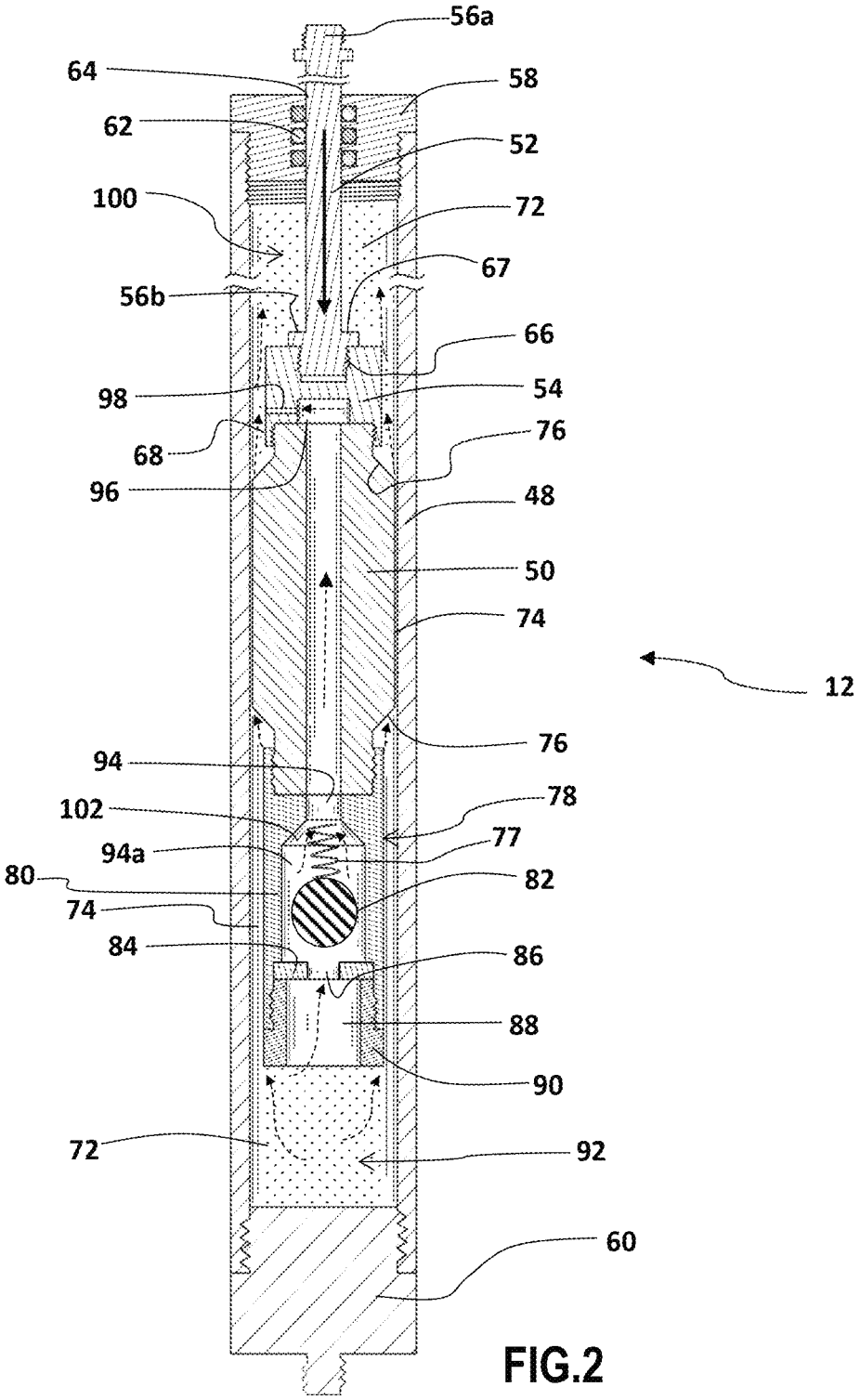
FIG. 2 is a sectional view of the self-adjusting downhole sucker rod pump spacing tool in accordance with a second preferred embodiment depicting the piston moving downward and the fluid upward during a tagging procedure.

Referring to FIG. 2, the self-adjusting downhole sucker rod pump spacing tool 12 of a second preferred embodiment generally comprises the cylinder 48, the piston 50, and the piston rod 52. The piston rod 52 and piston 50 are attached to one another via the intermediate connector 54 and are coaxially positioned within the cylinder 48 such that the piston 50 and piston rod 52 share a central longitudinal axis with the cylinder 48. The piston 50 has an outside diameter that is slightly less than an inside diameter of the cylinder 48. Thus, the lateral space 74 is also present in the second embodiment between the piston 50 and the cylinder 48. Similar to the first embodiment, the lateral space 74 of the second embodiment permits fluid 72 to pass between the piston 50 and the cylinder 48. The piston 50 of certain embodiments comprise tapered ends 76 such that the piston 50 is narrower at the top and bottom than the middle. This configuration assists in funneling the fluid 72 within the lateral space 74 between the piston 50 and the cylinder 48 when the piston 50 is reciprocated within the cylinder 48.

The upper portion of the piston rod 52 comprises a conventional threaded connector portion 56*a* configured to connect the piston rod 52 to the lowermost portion of the sucker rod string 36. The lower portion of the piston rod 52 comprises the conventional threaded connector portion 56*b* and optional flange 67 arrangement configured to connect the piston rod 52 to the intermediate connector 54.

The cylinder 48 is enclosed at the top with the upper seal cap 58 and enclosed at the bottom with the lower cap 60. The upper seal cap 58 comprises seals 62 which surround the piston rod 52. This arrangement permits the piston rod 52 to be repositioned axially within a central opening 64 of the upper seal cap 58 while also preventing fluid within the cylinder 48 from escaping the cylinder 48. The upper and lower caps 58, 60 are each threadedly connected to the cylinder 48.

The lower portion of the piston rod 52 is connected to an upper connector portion 66 of the intermediate connector 54. The upper end of the piston 50 is connected to a lower portion 68 of the intermediate connector 54. The lower end of the piston 50 comprises a valve assembly 78 threadedly connected to the piston 50.

The valve assembly 78 of preferred embodiments is a one-way check valve assembly 78 comprising a valve body 80, a ball 82, and a seat 84, the seat 84 comprising a fluid passage 86. The fluid passage 86, when in an open condition, is fluidly communicative with a chamber 88 of a valve body seat plug 90. The valve body seat plug 90 of this embodiment is threadedly connected to the valve body 80. The valve body seat plug 90 is fluidly communicative with the lower cylinder chamber 92. An upper end of the valve body 80 comprises a funnel configuration 102 the wide portion of the "funnel" 102 being below the narrow portion. Extending upward from the valve body 80 is piston conduit 94. The piston conduit 94 is fluidly connected to the valve body 80 and is coaxial with the piston 50. At an upper end of the piston conduit 94, and fluidly connected to the piston conduit 94, are piston conduit dome 96 and piston conduit dome passage 98. The piston conduit dome passage 98 extends through the intermediate connector 54 to a position exterior to the intermediate connector 54 within an upper cylinder chamber 100.

The operation of the self-adjusting downhole sucker rod pump spacing tool 12 of the second preferred embodiment will now be discussed. Referring to the figures, and in particular, FIGS. 2 and 4, the downhole sucker rod pump spacing tool 12 is first adjusted by touching the tool 12 against the sucker rod pump 22 while the tool 12 and sucker rod pump 22 are both downhole. This action of moving the tool 12 such that a lowest portion of the tool 12 contacts a portion of the sucker rod pump 22 causes the piston 50 to move towards a lower portion of the cylinder 48 which shortens an overall length of the downhole sucker rod pump spacing tool 12. The touching action caused by the downstroke of the pump jack 34, the sucker rod string 36 attached to the piston rod 52 causes the piston rod 52, piston 50, valve assembly 78, and the valve body seat plug 90 to move downward within the cylinder 48. The fluid 72 moves upward along a path defined by the lateral space 74 between the piston 50, valve assembly 78, the valve body seat plug 90 and the cylinder 48. In the second embodiment, the touching action also causes the ball 82 to rise from the seat 84 such that the fluid 72 also passes from the lower cylinder chamber 92, through the valve body seat plug chamber 88, through the valve seat fluid passage 86, the piston conduit 94, piston conduit dome 96, piston conduit dome passage 98, and into the upper cylinder chamber 100 (rising ball 82 shown in dashed lines in FIG. 2). In preferred embodiments, it is only the touching action that causes the piston 50 to move appreciably downward and for the ball 82 to rise from the seat 84. Normal downstrokes that do not cause a touch between the spacing tool 12 and the sucker rod pump 22 will not cause the piston to move appreciably downward.

On the upstroke, the ball 82 is once again seated on the seat 84 and the piston 50 does not move appreciably upward within the cylinder 48 and the fluid 72 within the upper cylinder chamber 100 does not move appreciably downward. Therefore, as occurs in the first embodiment, in the second embodiment, virtually no fluid 72 moves within the lateral space 74 during regular pumping action of the pump jack 34. Consequently, on every normal upstroke and downstroke the self-adjusting downhole sucker rod pump spacing tool 12 approximately retains its position relative to the sucker rod pump 22.

As with the first embodiment, in the second embodiment, after thousands of strokes/reciprocations, the piston 50 will gradually change position within the cylinder 48 causing the overall length of the spacing tool 12 to lengthen resulting in a decreased distance between the spacing tool 12 and the sucker rod pump 22. As this decreased distance may ultimately result in the spacing tool 12 once again touching the sucker rod pump 22, upon a new touch, the self-adjusting downhole sucker rod pump spacing tool 12 self-adjusts as described above, such that its overall length again becomes shorter.

Although the dimensions can vary, the following additional approximate dimensions are provided for preferred embodiments. The ball 82 has a diameter of one inch. The seat 84 fluid passage 86 has a diameter of approximately ⅞ inch. The piston conduit 94 has a diameter of approximately ⅝ inch and the piston conduit dome passage 98 has a diameter of approximately ½ inch. The valve assembly 78 has a length of approximately four inches and an outside diameter of approximately 1 7/16 inches. The valve body seat plug chamber 88 has a diameter of approximately 1".

A Third Embodiment

Figure 3:
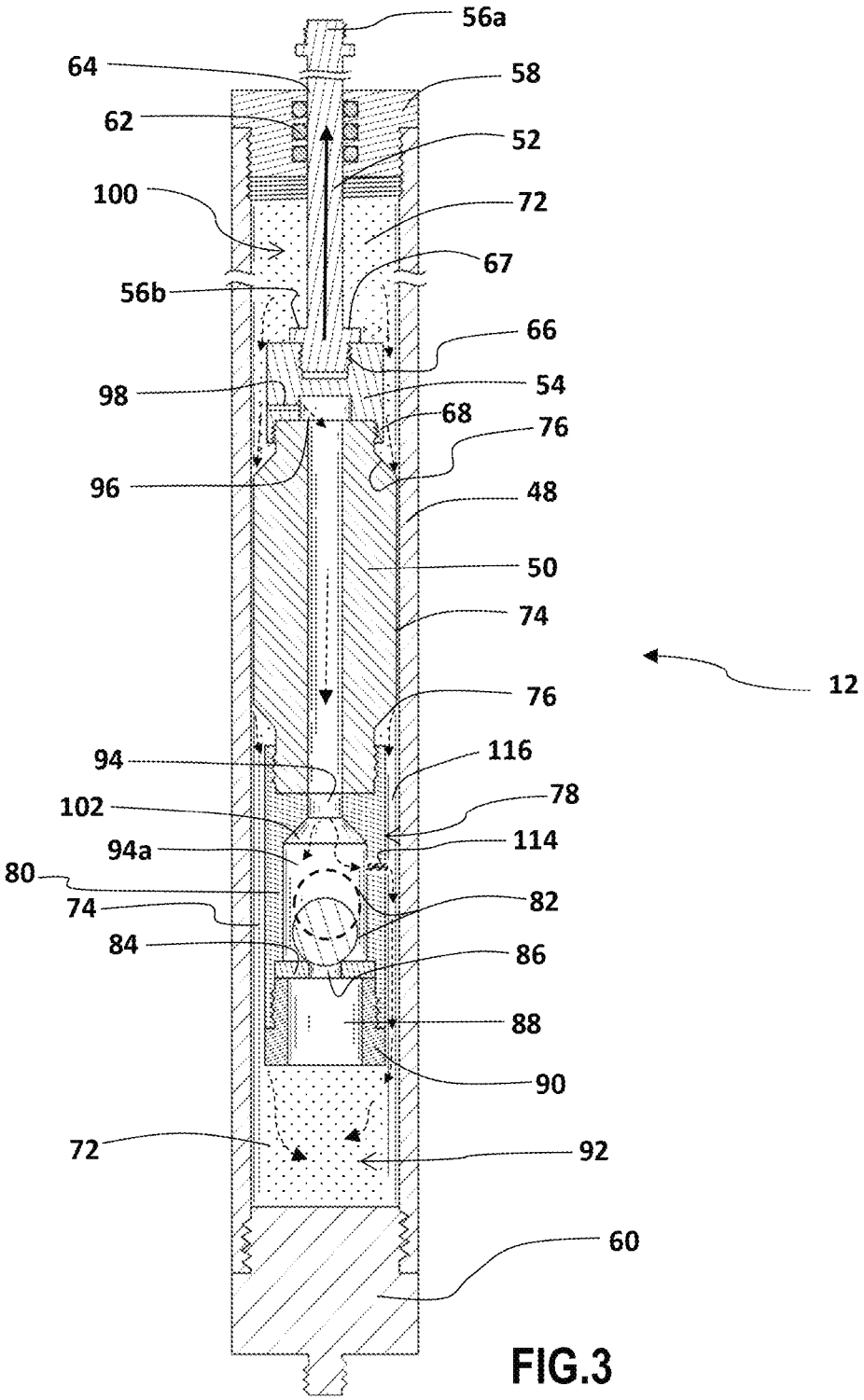
FIG. 3 is a sectional view of the self-adjusting downhole sucker rod pump spacing tool in accordance with a third preferred embodiment depicting the piston moving upward and the fluid downward during an upstroke.

Referring to FIG. 3, the self-adjusting downhole sucker rod pump spacing tool 12 of a third embodiment is similar to that of the second embodiment with the addition of an orifice 114. The orifice 114 of preferred embodiments is a through opening that permits fluid communication between a valve body chamber 94*a* and a space 116 between the valve assembly and the cylinder 48. In this embodiment, the action caused by the upstroke of the pump jack 34 causes the piston 50, valve assembly 78, and the valve body seat plug 90 to move upward within the cylinder 48 causing the fluid 72 to move downward from the upper cylinder chamber 100, into the space 116 between the valve assembly and the cylinder 48, through the orifice 114, through the valve body 80, and into the lower cylinder chamber 92. In certain aspects of this embodiment, the fluid 72 does not pass through the piston conduit 94. However, in other aspects of this embodiment, the fluid 72 passes through both the piston conduit 94 as described in the second embodiment and also through the orifice 114 as described above. In preferred embodiments, the orifice 114 is formed by of a threaded assembly inserted into a side of the valve assembly 78. The orifice 114 can be positioned in other positions that permit fluid 72 to move, via the orifice 114, to and between the first and second chambers 100, 92. It is advantageous and preferable that the orifice 114 be positioned above the ball seat 84 as an important aspect of the orifice 114 is that it permits an increased flow of fluid 72 into the lower cylinder chamber 92 on the upstroke while the ball 82 is seated. The orifice 114 of the preferred embodiment is an opening having a diameter of 1/64 of an inch, for example.

Referring to FIG. 2, the self-adjusting downhole sucker rod pump spacing tool 12 may, optionally, comprises a coil compression spring 77. This spring 77 is useful when, for example, the spacing tool 12 is inverted such that the piston rod 52 is coupled to the sucker rod pump 22. Because the spring 77 of the preferred embodiment is a coil spring 77, the spring 77 itself does not appreciably restrict fluid flow.

In preferred embodiments, the spring 77 is positioned proximate the funnel configuration 102 portion of the valve body 80. In such position, when the ball 82 is at rest and not significantly acted upon by forces other than gravity and the spring, the spring 77 biases the ball 82 towards the valve body seat 84 and away from the upper end of the valve body 80. Thus, the spring 77 preferably comprises a spring constant sufficient to prevent the force of gravity from causing the ball 82 to undesirably occlude the piston conduit 94, but not so great as to interfere with normal valve function under operating conditions. Under normal working pressures, the ball 82 and valve assembly 78 will function in substantially the same manner as embodiments not comprising a spring 77.

DISCLOSURE NOT TO BE LIMITED

Although certain dimensions have been provided with respect to the various embodiments, the self-adjusting downhole sucker rod pump spacing tool 12 can have different dimensions. For example, the tool 12 can be longer or shorter than what has been specifically described. The various passages and conduits can be wider or narrower. The clearances described can be wider or narrower.

In preferred embodiments, the self-adjusting downhole sucker rod pump spacing tool 12 is formed from steel. However, the self-adjusting downhole sucker rod pump spacing tool 12 need not necessarily be formed from steel. Rather, the tool 12 can be formed from any suitable material known in the art or which may be later developed in the art. For example, the self-adjusting downhole sucker rod pump spacing tool 12 can be made from natural or man-made materials capable of withstanding the pressures and caustic nature of the downhole environment.

In preferred embodiments, the self-adjusting downhole sucker rod pump spacing tool 12 is described as having the capacity to work with a downhole reciprocating sucker rod pump 22 in which the sucker rod pump 22 barrel is sealedly or threadedly affixed to the tubing and the sucker rod pump plunger reciprocates within the stationary sucker rod pump barrel. However, the embodiments are equally adapted to work with other types of sucker rod pumps such as a travel barrel pump or insert style pumps.

In preferred embodiments, the various components of the self-adjusting downhole sucker rod pump spacing tool 12 are described as being attached/connected/joined in certain manners. For example, many of the components are joined to adjacent components with cooperative threaded fasteners. Some of the figures show such threaded fasteners having either a male end or a female end. However, the various components can be joined together using conventional and commercially available fastening techniques and fasteners well known in the art. For example, some components can be welded to an adjacent component. By way of further example, a component shown in the figures as having a male end may have a female end and vice versa. Any suitable fastening means may be substituted for fastening means described in this disclosure.

In preferred embodiments, various valve arrangements are shown. For example, in the second and third embodiments, the valve assembly 78 depicted is a one-way check valve assembly comprising a ball check valve arrangement. However, the valve assembly 78 can comprise other conventional and commercially available valve arrangements well known in the art that have the capacity to restrict and open flow as needed to permit fluid 72 to move throughout the self-adjusting downhole sucker rod pump spacing tool 12.

While there has been illustrated and described what is, at present, considered to be preferred embodiments of the present invention, it will be understood by those skilled in the art that various changes and modifications may be made, and equivalents may be substituted for elements thereof without departing from the true scope of the invention. Therefore, it is intended that this invention not be limited to the particular embodiment disclosed as the best mode contemplated for carrying out the invention, but that the invention will include all embodiments falling within the scope of this disclosure. Additionally, the particular features, structures, or characteristics of each of the embodiments discussed herein may be combined in any suitable manner in one or more embodiments and in alternative configurations without limitation.

We claim:

1. A self-adjusting downhole sucker rod pump spacing tool comprising:

a cylinder, a piston, and a piston rod, the piston rod comprising first and second ends, the first end being external to the cylinder, the second end being positioned within a sealed cylinder chamber and operatively connected to the piston;

the cylinder confining fluid within the cylinder chamber, the cylinder chamber comprising a first chamber and a second chamber;

the piston being coaxially positioned within the cylinder chamber such that the piston shares a central longitudinal axis with the cylinder;

the piston and cylinder each comprising respective sidewalls, the respective sidewalls defining a lateral space between the piston and the cylinder;

the piston and piston rod each having the capacity to relocate along the central longitudinal axis of the cylinder;

whereupon movement of the piston to a first position, a first portion of the fluid moves from the first chamber to the second chamber through the lateral space without passing through the piston;

whereupon movement of the piston to a second position, a second portion of the fluid moves from the second chamber to the first chamber through the lateral space without passing through the piston, wherein movement of the piston changes the distance between the spacing tool and a sucker rod pump positioned downhole from the spacing tool.

2. The self-adjusting downhole sucker rod pump spacing tool of claim 1 wherein:

the first end of the piston rod is structured and arranged to be operatively connected to a sucker rod string such that when so connected, the first end of the piston rod is positioned between the piston and the sucker rod string; and the cylinder comprises a seal cap though which the piston rod capable of moving, the seal cap being positioned between the piston and the sucker rod string when the first end of the piston rod is operatively connected to the sucker rod string.

3. The self-adjusting downhole sucker rod pump spacing tool of claim 1 wherein:

the first end of the piston rod is structured and arranged to be operatively connected to a sucker rod pump such that when so connected, the first end of the piston rod is positioned between the piston and the sucker rod pump; and the cylinder comprises a seal cap though which the piston rod is capable of moving, the seal cap being positioned between the piston and the sucker rod pump.

4. The self-adjusting downhole sucker rod pump spacing tool of claim 1, wherein the lateral space has the capacity to permit the fluid to move from the first chamber to the second chamber and to permit the fluid to move from the second chamber to the first chamber.

5. The self-adjusting downhole sucker rod pump spacing tool of claim 1, further comprising a piston conduit, the piston conduit having the capacity to permit the fluid to move from the second chamber to the first chamber.

6. The self-adjusting downhole sucker rod pump spacing tool of claim 1, wherein the piston comprises tapered ends.

7. The self-adjusting downhole sucker rod pump spacing tool of claim 1, further comprising a valve assembly having the capacity to permit a portion of the fluid to move from the second chamber to the first chamber.

8. The self-adjusting downhole sucker rod pump spacing tool of claim 7, the valve assembly comprising a one-way check valve assembly.

9. The self-adjusting downhole sucker rod pump spacing tool of claim 8, further comprising a piston conduit, the piston conduit being fluidly connected to the valve body such that upon movement of the piston towards the second chamber, the ball is displaced from the seat, allowing fluid to flow from the second chamber through the piston conduit to the first chamber.

10. A self-adjusting downhole sucker rod pump spacing tool comprising:

a cylinder, a piston, a piston rod, and a valve assembly, the piston rod comprising first and second ends, the first end being external to the cylinder and configured to be connected to a sucker rod string, the second end being positioned within a sealed cylinder chamber and operatively connected to the piston;

the cylinder confining fluid within the cylinder chamber, the cylinder chamber comprising a first chamber and a second chamber;

the piston being coaxially positioned within the cylinder chamber such that the piston shares a central longitudinal axis with the cylinder;

the piston and cylinder each comprising respective sidewalls, the respective sidewalls defining a lateral space between the piston and the cylinder;

the valve assembly having the capacity to permit a portion of the fluid to move from the second chamber to the first chamber;

the cylinder comprising a seal cap though which the piston rod is capable of moving;

the piston and piston rod each further having the capacity to relocate along the central longitudinal axis of the cylinder;

whereupon movement of the piston to a first position, a first portion of the fluid moves from the first chamber to the second chamber through the lateral space without passing through the piston;

whereupon movement of the piston to a second position, a second portion of the fluid moves from the second chamber to the first chamber through the lateral space without passing through the piston, wherein movement of the piston changes the distance between the spacing tool and a sucker rod pump positioned downhole from the spacing tool.

11. The self-adjusting downhole sucker rod pump spacing tool of claim 10, the lateral space having the capacity to permit the fluid to move from the first chamber to the second chamber and to permit the fluid to move from the second chamber to the first chamber.

12. The self-adjusting downhole sucker rod pump spacing tool of claim 10, further comprising a piston conduit, wherein:

the valve assembly comprises a one-way check valve assembly;

the piston conduit is fluidly connected to the one-way check valve assembly such that upon movement of the piston towards the second chamber, the ball is displaced from the seat allowing fluid to flow from the second chamber through the piston conduit to the first chamber.

13. The self-adjusting downhole sucker rod pump spacing tool of claim 12, further comprising an orifice, the orifice being fluidly connected between the first and second chambers through piston conduit such that upon movement of the piston towards the first chamber, fluid is allowed to flow from the first chamber through the orifice to the second chamber.

14. A self-adjusting downhole sucker rod pump spacing tool comprising:

a cylinder, a piston, a piston rod, and a valve assembly, the piston rod comprising first and second ends, the first end being external to the cylinder and configured to be connected to a sucker rod pump, the second end being positioned within a sealed cylinder chamber and operatively connected to the piston;

the cylinder confining fluid within the cylinder chamber, the cylinder chamber comprising a first chamber and a second chamber;

the piston being coaxially positioned within the cylinder chamber such that the piston shares a central longitudinal axis with the cylinder;

the piston and cylinder each comprising respective sidewalls, the respective sidewalls defining a lateral space between the piston and the cylinder;

the valve assembly having the capacity to permit a portion of the fluid to move from the second chamber to the first chamber;

the cylinder comprising a seal cap though which the piston rod is capable of moving; the piston and piston rod each further having the capacity to relocate along the central longitudinal axis of the cylinder;

whereupon movement of the piston to a first position, a first portion of the fluid moves from the first chamber to the second chamber through the lateral space without passing through the piston;

whereupon movement of the piston to a second position, a second portion of the fluid moves from the second chamber to the first chamber through the lateral space without passing through the piston, wherein movement of the piston changes the distance between the spacing tool and a sucker rod pump positioned downhole from the spacing tool.

15. The self-adjusting downhole sucker rod pump spacing tool of claim 14, the lateral space having the capacity to permit the fluid to move from the first chamber to the second chamber and to permit the fluid to move from the second chamber to the first chamber.

16. The self-adjusting downhole sucker rod pump spacing tool of claim 14, further comprising a piston conduit, wherein:

the valve assembly comprises a one-way check valve assembly;

the piston conduit is fluidly connected to the one-way check valve assembly such that upon movement of the piston towards the second chamber, the ball is displaced from the seat allowing fluid to flow from the second chamber through the piston conduit to the first chamber.

17. The self-adjusting downhole sucker rod pump spacing tool of claim 16, further comprising an orifice, the orifice being fluidly connected between the first and second chambers through piston conduit such that upon movement of the piston towards the second chamber, fluid is allowed to flow from the first chamber through the orifice to the second chamber.

18. The self-adjusting downhole sucker rod pump spacing tool of claim 14, the valve assembly further comprising a spring.

* * * * *